US008657186B2

(12) United States Patent
Grimard

(10) Patent No.: US 8,657,186 B2
(45) Date of Patent: Feb. 25, 2014

(54) TAGGING AND IDENTIFICATION SYSTEM FOR LUGGAGE

(76) Inventor: Louise Grimard, Ste-Therese (CA)

( * ) Notice: Subject to any disclaimer, the term of this patent is extended or adjusted under 35 U.S.C. 154(b) by 57 days.

(21) Appl. No.: 13/298,913

(22) Filed: Nov. 17, 2011

(65) Prior Publication Data

US 2013/0130741 A1 May 23, 2013

(51) Int. Cl.
*G06F 17/00* (2006.01)

(52) U.S. Cl.
USPC ..... 235/375

(58) Field of Classification Search
USPC ..... 235/375
See application file for complete search history.

(56) References Cited

U.S. PATENT DOCUMENTS

| | | | |
|---|---|---|---|
| 6,847,892 | B2 | 1/2005 | Zhou et al. |
| 6,978,118 | B2 | 12/2005 | Vesikivi et al. |
| 6,994,262 | B1 | 2/2006 | Warther |
| 7,309,015 | B2 | 12/2007 | Frantz et al. |
| 7,490,134 | B2 | 2/2009 | Ono et al. |
| 7,502,133 | B2 | 3/2009 | Fukunaga et al. |
| 7,520,419 | B2 | 4/2009 | Libin et al. |
| 7,535,358 | B2 | 5/2009 | Crider et al. |
| 7,583,285 | B2 | 9/2009 | Otaka et al. |
| 7,798,417 | B2 | 9/2010 | Snyder et al. |
| 7,823,784 | B2 | 11/2010 | Matsumoto |
| 7,830,556 | B2 | 11/2010 | Sukui et al. |
| 7,845,569 | B1 | 12/2010 | Warther |
| 7,916,025 | B2 | 3/2011 | Locker et al. |
| 8,010,621 | B2 | 8/2011 | Zilliacus et al. |
| 2003/0085268 | A1* | 5/2003 | Kruse et al. ..... 235/375 |
| 2005/0061890 | A1 | 3/2005 | Hinckley |
| 2009/0031071 | A1 | 1/2009 | Chiu |
| 2009/0164238 | A1 | 6/2009 | Auchinleck |
| 2010/0089996 | A1 | 4/2010 | Koplar |
| 2010/0223245 | A1 | 9/2010 | Vermilye |
| 2011/0082747 | A1 | 4/2011 | Khan et al. |
| 2011/0133904 | A1 | 6/2011 | Warther |
| 2011/0202429 | A1 | 8/2011 | Graff et al. |

FOREIGN PATENT DOCUMENTS

| | | |
|---|---|---|
| CN | 201166851 | 12/2008 |
| JP | 2006209711 | 8/2006 |
| JP | 2011054009 | 3/2011 |

* cited by examiner

*Primary Examiner* — Jamara Franklin

(57) ABSTRACT

An itinerary travel tag attached to a piece of luggage, the travel tag including a code; a mechanism for retrieving and sending the code electronically; an internet server connected electronically to the mechanism for receiving the code, and for providing a website including a webpage associated with the code and used to provide information pertaining to the piece of luggage, such that the piece of luggage can be tracked and the information used remotely to locate and retrieve the piece of luggage at any time and in any location.

20 Claims, 3 Drawing Sheets

TAGGING AND IDENTIFICATION SYSTEM FOR LUGGAGE

FIELD OF THE INVENTION

The present invention relates generally to luggage but more particularly to a tagging and identification system using information technology to alert of lost or missing luggage.

BACKGROUND OF THE INVENTION

Lost luggage is a major inconvenience for travelers all over the world. Whether it is the fault of airline companies or outright theft, the result is the same. In the case of misdirected luggage, having a convenient and reliable means to alert the luggage owner that the luggage has been found would be a bonus.

SUMMARY OF THE INVENTION

In view of the foregoing disadvantages inherent in the known devices now present in the prior art, the present invention, which will be described subsequently in greater detail, is to provide objects and advantages which are:

To provide for a convenient and reliable tagging and identification system using information technology to alert of lost or missing luggage.

In order to do so, an itinerary travel tag attached to a piece of luggage, the travel tag including a code; a mechanism for retrieving and sending the code electronically; an internet server connected electronically to the mechanism for receiving the code, and for providing a website including a webpage associated with the code and used to provide information pertaining to the piece of luggage, such that the piece of luggage can be tracked and the information used remotely to locate and retrieve the piece of luggage at any time and in any location.

The tagging and identification system wherein there is a scanning mechanism and a reading mechanism.

The code being used is a QR code.

The piece of luggage includes a plaque wherein the QR code is permanently embedded on the plaque, such that the code is readable by the scanning mechanism.

The tagging and identification system can alternatively have a tag holder with the QR code inserted therein such that the code is readable by the scanning mechanism.

The tagging and identification system wherein the scanning mechanism is a cellular phone or a dedicated QR code reader The code can also be an alphanumeric code which is automatically associated with the QR code, such that when the QR code is unreadable a person can use the alphanumeric code to access the web page.

The tagging and identification system where the webpage includes means for inputting information about the piece of luggage; and includes means for displaying the information about the piece of luggage, such that if the piece of luggage is lost in transit, a person who locates it can read and send the code on the piece of luggage, access the webpage, retrieve the information, and then contact the owner about its location and available retrieval options.

The tagging and identification system also includes information about the piece of luggage includes instructions as to steps to take to return the luggage to its owner. The information about the piece of luggage includes the owner's e-mail address and phone number. Also, the information about the piece of luggage includes airline flight numbers, stop overs, airline companies, and additional information pertaining to checked, unchecked, and consigned luggage.

The tagging and identification system further includes the webpage's URL, such that the alphanumeric code can be entered manually onto the webpage.

The website includes a database storing information about the baggage and information of a plurality of clients.

The website includes a link directing to a translating website for translating for any one language to any other language.

The website further incorporates a changeable password for each individual client.

A method of tracking, locating, and retrieving lost luggage comprising the steps of:

a.) attaching an itinerary travel tag to a piece of luggage, the travel tag including a code;

b.) providing a mechanism for retrieving and sending the code electronically;

c.) providing an internet server connected electronically to the mechanism for receiving the code;

d.) providing a webpage, associated with the code, upon the server for providing information pertaining to the piece of luggage, wherein the webpage includes means for inputting information about the piece of luggage; and includes means for displaying the information about the piece of luggage, such that if the piece of luggage is lost in transit, a person who locates it can read and send the code, access the webpage, retrieve the information, and then contact the owner about its location and available retrieval options.

The method of tracking, locating, and retrieving lost luggage wherein the means for inputting information includes the steps of:

e.) filling out a registration page that asks for a client's personal data which includes their name, address, contact information, e-mail address, and phone number;

f.) filling out an instructions page, that can be used by a person who finds the piece of luggage, setting forth instructions on how to return the piece of luggage to the client whom owns the piece of luggage.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION OF THE PREFERRED EMBODIMENT

Figure 1:
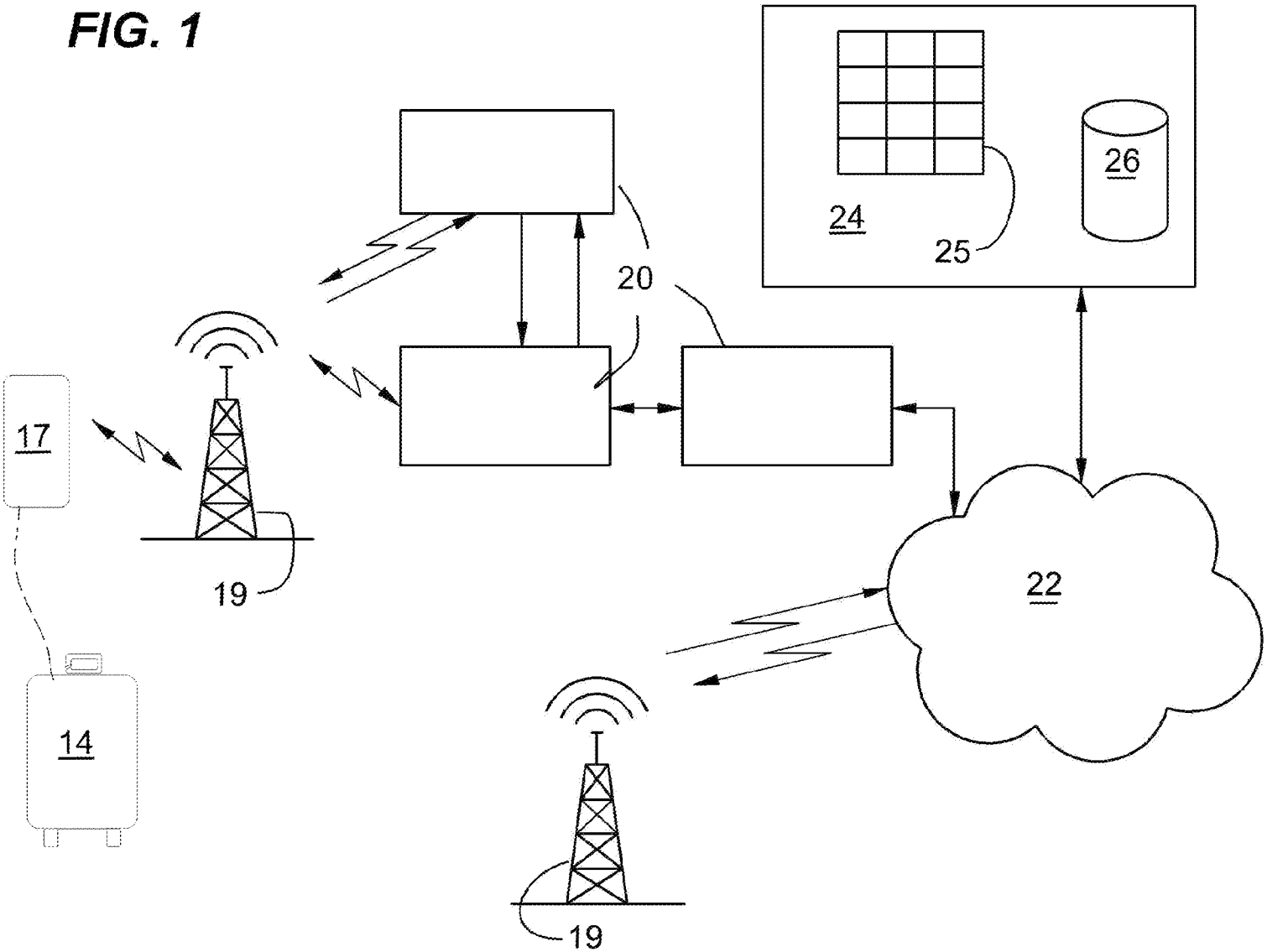
FIG. 1 Schematic view of the process in general.
Figure 2:
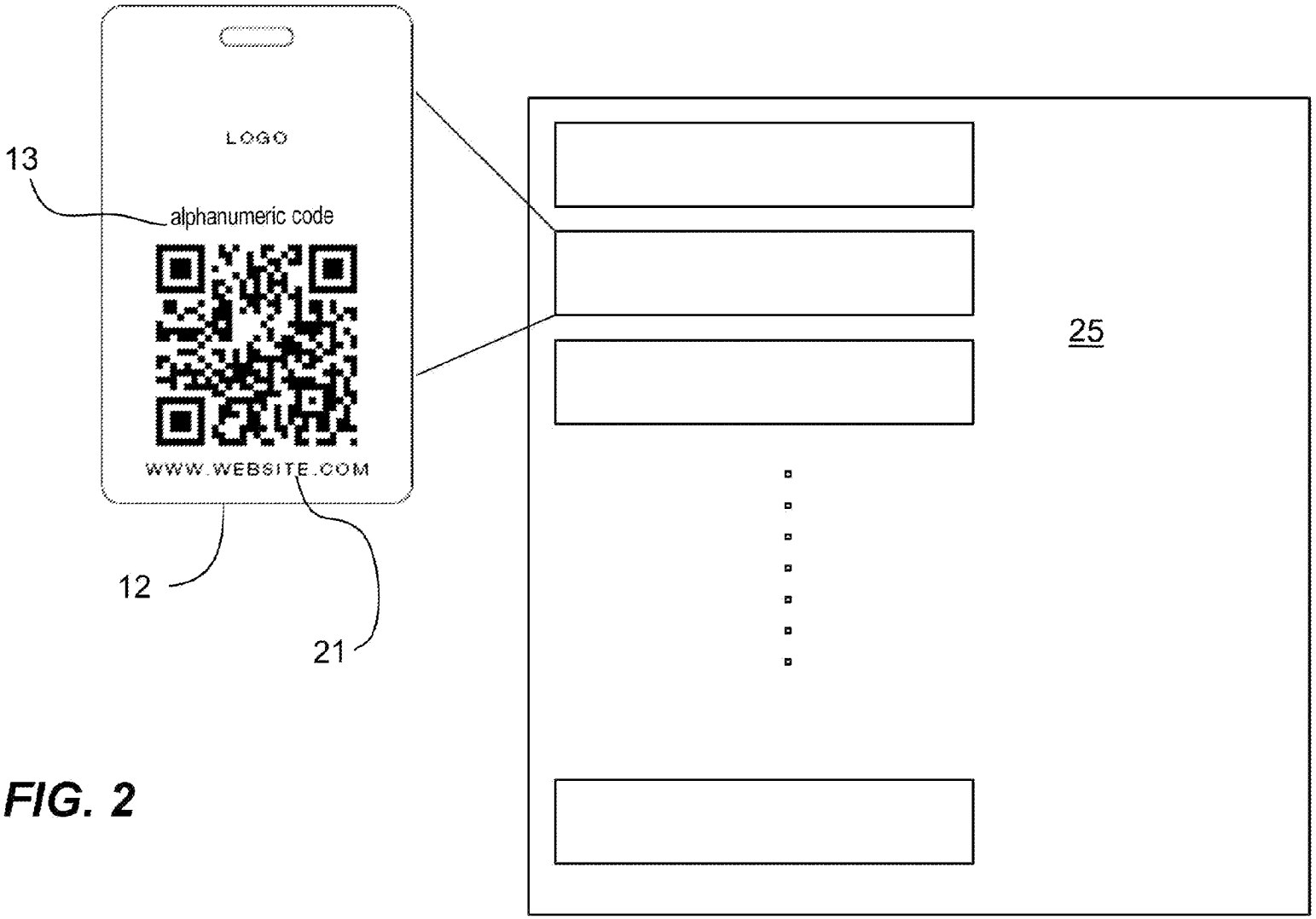
FIG. 2 Schematic view of the web interface.
Figure 3:
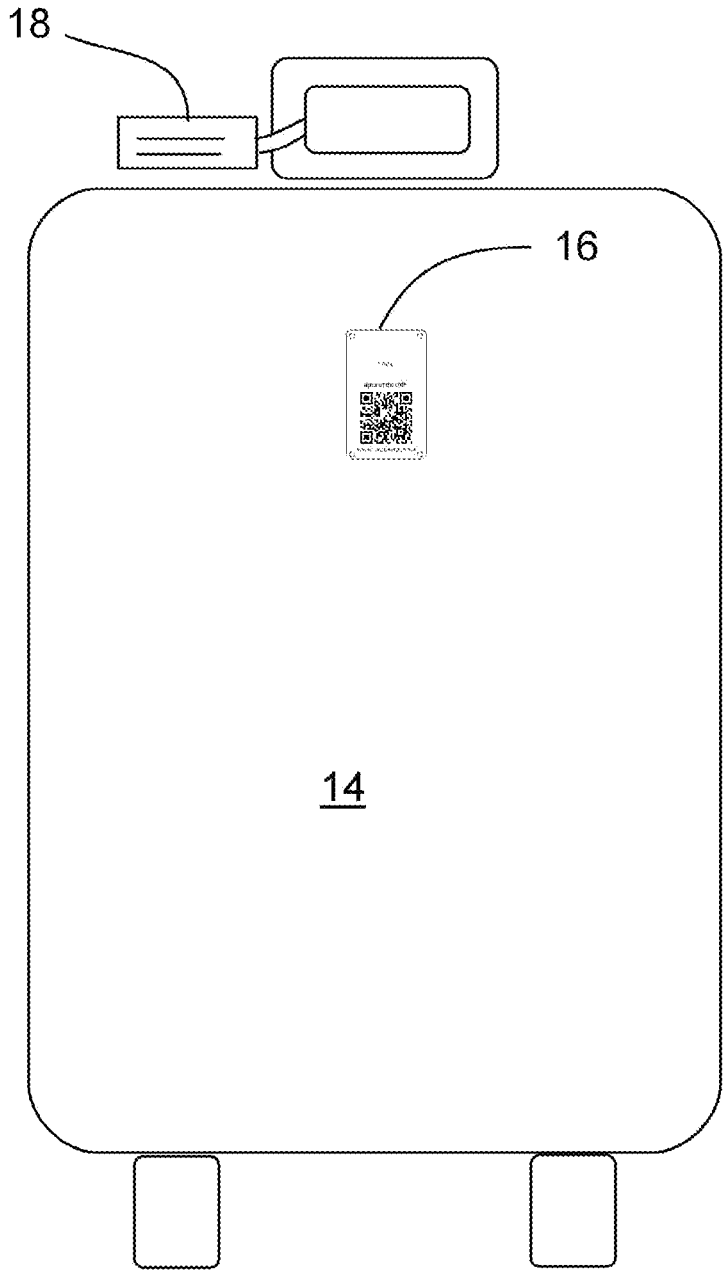
FIG. 3 Side view of luggage with a tag holder and an embedded QR code.

A Tagging and identification system for luggage is comprised of an itinerary travel tag (12) located on a piece of luggage (14). The itinerary travel tag (12) has a QR code (16). The itinerary travel tag (12) can be either embedded on a plaque on the outside of the luggage (14), or it can be inserted into a tag holder (18) for luggage (14), as known in the art. When used on a tag holder (18) information in the traditional format (that is alpha numerically) can be placed along with the itinerary travel tag (12) as per FIG. 3.

When a lost luggage (14) is found, the QR code (16) is scanned, for example, by a cellular phone (17) and a signal is sent by way of a cellular phone service provider (19), the signal is carried via airwaves as data on an IP network and eventually by landlines (20) and through Internet network (22) to an Internet connected server (24) hosting a website (25) which has a database (26) wherein all the pertinent clients information is held. Given that people finding the luggage may speak any one of a variety of language, the website (25) provides a link directing to a translating website for translating for any one language to any other language. As a backup to the QR code (16), an alphanumeric code (13) can be used when there is no convenient way of scanning the QR code (16). The itinerary travel tag (12) contains the website's (25) URL (21) so that the alphanumeric code can be entered so as to lead to the proper page.

From a client perspective, all the pertinent information is entered by the client or for the client onto the password protected client's personal page on the website (25). No need to scan the QR code as simply entering the alphanumeric code (13) automatically associates it with the QR code (16) and the client's page on the website (25). Typically, for a new, unregistered luggage (14), the QR code (16) redirects to a registration page where the client or the store clerk enters the client's personal data such as name, address, contact information and and a choice of responses the client wishes to get in case of loss of luggage (14), such as receiving an email, a phone call, or any other of a variety of such responses. Once initial registration is done, and from then on, whenever the QR code (16) is scanned or the alphanumeric code (13) is entered, it leads to a special instructions page on the website (25) where the instructions will be given to whoever found the luggage (14) as to what to do to return the luggage (14) back to its rightful owner.

Current technology, such as on smart phones, allows for the luggage (14) owner to obtain the geo location of whoever found the luggage (14) for an even easier way of retrieving lost luggage (14).

The nature of the information on the website comprises but is not limited to the following: Itinerary, flight numbers, stop overs, airline companies, and any additional information concerning checked, unchecked and consigned luggage.

As to a further discussion of the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A tagging and identification system comprising an itinerary travel tag attached to a piece of luggage, said travel tag including a code; a mechanism for retrieving and sending said code electronically; an internet server connected electronically to said mechanism for receiving said code, and for providing a website including a webpage associated with said code and used to provide information pertaining to said piece of luggage, such that said piece of luggage is tracked and said information used remotely to locate and retrieve said piece of luggage at any time and in any location; and a website including said webpage adapted to retrieve and send said information pertaining to said piece of luggage.

2. The tagging and identification system of claim 1, wherein said mechanism is a scanning mechanism.

3. The tagging and identification system of claim 2, wherein said code is a QR code.

4. The tagging and identification system of claim 1, wherein said mechanism is a reading mechanism.

5. The tagging and identification system of claim 3, wherein said piece of luggage includes a plaque; and wherein said QR code is permanently embedded on said plaque, such that said code is readable by said scanning mechanism.

6. The tagging and identification system of claim 3, wherein said piece of luggage includes a tag holder; and wherein said QR code is inserted within said tag holder, such that said code is readable by said scanning mechanism.

7. The tagging and identification system of claim 3, wherein an alphanumeric code is automatically associated with said QR code, such that when said QR code is unreadable a person uses said alphanumeric code to access said web page.

8. The tagging and identification system of claim 6, wherein said information about said piece of luggage includes instructions as to steps to take to return said luggage to the owner of said luggage.

9. The tagging and identification system of claim 6, wherein said information about said piece of luggage includes said owner's e-mail address and phone number.

10. The tagging and identification system of claim 6, wherein said information about said piece of luggage includes airline flight numbers, stop overs, airline companies, and additional information pertaining to checked, unchecked, and consigned luggage.

11. The tagging and identification system of claim 2, wherein said scanning mechanism is chosen from a list of scanning mechanisms including a cellular phone.

12. The tagging and identification system of claim 4, wherein said code is an alphanumeric code.

13. The tagging and identification system of claim 3, wherein said reading mechanism includes an electronic device chosen from a list of electronic devices including a smart phone, and a dedicated QR reader.

14. The tagging and identification system of claim 12, wherein said travel tag further includes said webpage's URL, such that said alphanumeric code is entered manually onto said webpage.

15. The tagging and identification system of claim 14, wherein said website further incorporates a changeable password for each individual client.

16. The tagging and identification system of claim 1, wherein said webpage includes means for inputting information about said piece of luggage; and includes means for displaying said information about said piece of luggage, such that if said piece of luggage is lost in transit, a person who locates said piece of luggage reads and send said code on said piece of luggage, access said webpage, retrieve said information, and then contact said owner about the location of the piece of luggage and available retrieval options.

17. The tagging and identification system of claim 1, wherein said website includes a database storing information about said baggage and information of a plurality of clients.

18. The tagging and identification system of claim 1, wherein said website has a link directing to a translating website for translating for any one language to any other language.

19. A method of tracking, locating, and retrieving lost luggage comprising the steps of:

a.) attaching an itinerary travel tag to a piece of luggage, said travel tag including a code;

b.) providing a mechanism for retrieving and sending said code electronically;

c.) providing an Internet server connected electronically to said mechanism for receiving said code;

d.) providing a webpage, associated with said code, upon said server for providing information pertaining to said piece of luggage, wherein said webpage includes means for inputting information about said piece of luggage; and includes means for displaying said information about said piece of luggage, such that if said piece of luggage is lost in transit, a person who locates said piece of luggage can read and send said code, access said webpage, retrieve said information, and then contact said owner about the location of the piece of luggage and available retrieval options.

20. The method of tracking, locating, and retrieving lost luggage of claim 19, wherein the means for inputting information includes the steps of:

e.) filling out a registration page that asks for a client's personal data which includes their name, address, contact information, e-mail address, and phone number;

f.) filling out an instructions page, that is used by a person who finds said piece of luggage, setting forth instructions on how to return said piece of luggage to said client whom owns said piece of luggage.

* * * * *